US007102595B2

(12) United States Patent
Park

(10) Patent No.: US 7,102,595 B2
(45) Date of Patent: Sep. 5, 2006

(54) DRIVING METHOD OF PLASMA DISPLAY PANEL

(75) Inventor: Hun Gun Park, Seoul (KR)

(73) Assignee: LG Electronics Inc., Seoul (KR)

( * ) Notice: Subject to any disclaimer, the term of this patent is extended or adjusted under 35 U.S.C. 154(b) by 198 days.

(21) Appl. No.: 10/046,283

(22) Filed: Jan. 16, 2002

(65) Prior Publication Data

US 2002/0097202 A1 Jul. 25, 2002

(30) Foreign Application Priority Data

Jan. 19, 2001 (KR) ..... 2001-3213

(51) Int. Cl.
*G09G 3/28* (2006.01)

(52) U.S. Cl. ..... 345/60; 345/63

(58) Field of Classification Search ..... 345/60, 345/66–68, 37, 62, 63, 77, 71, 78; 315/169.1, 315/169.2, 169.4; 313/491, 492, 581–586
See application file for complete search history.

(56) References Cited

U.S. PATENT DOCUMENTS

| | | | | |
|---|---|---|---|---|
| 4,150,363 | A * | 4/1979 | Criscimagna et al. | 345/60 |
| 6,097,358 | A * | 8/2000 | Hirakawa et al. | 345/63 |
| 6,369,514 | B1 * | 4/2002 | Awamoto | 345/67 |
| 6,473,061 | B1 * | 10/2002 | Lim et al. | 345/60 |
| 6,531,819 | B1 * | 3/2003 | Nakahara et al. | 313/584 |
| 6,531,994 | B1 * | 3/2003 | Nagano | 345/60 |
| 6,552,701 | B1 * | 4/2003 | Tanaka | 345/63 |
| 6,587,084 | B1 * | 7/2003 | Alymov et al. | 345/60 |
| 6,603,446 | B1 * | 8/2003 | Kanazawa et al. | 345/60 |
| 6,717,557 | B1 * | 4/2004 | Ishizuka | 345/60 |
| 2001/0026254 | A1 * | 10/2001 | Ide et al. | 345/60 |
| 2003/0197661 | A1 * | 10/2003 | Choi | 345/60 |

FOREIGN PATENT DOCUMENTS

| | | |
|---|---|---|
| JP | 04-018594 | 1/1992 |
| JP | 04-029293 | 1/1992 |
| JP | 04-070895 | 3/1992 |

(Continued)

OTHER PUBLICATIONS

Y. Ikeda, K. Suzuki, H. Fukumoto, M. Shibata, M. Ishigaki, J.P. Verboncoeur, P.J. Christenson, and C.K. Birdsall□□"Global breakdown in an alternating current plasma display panel"□□Journal of Applied Physics vol. 89(8) pp. 4231-4239. □□Apr. 15, 2001.*

*Primary Examiner*—Amare Mengistu
(74) *Attorney, Agent, or Firm*—Fleshner & Kim, LLP.

(57) ABSTRACT

Disclosed is a driving method of a PDP (Plasma Display Panel) which removes excess charged particles collected on the outside of a display screen through a reciprocating action of a scan order. The driving method of a PDP (Plasma Display Panel) includes dividing a field of an input video signal into a plurality of sub-fields having brightness weights and applying a scan pulse. Next, applying an input video data signal pulse to address electrodes to have an address period designating cells to be displayed and a sustain period applying a sustain pulse to the designated cells according to the brightness weight of the corresponding sub-field, wherein the plurality of sub-fields include sub-fields, which have the address period applying the scan pulse to the scan electrodes to the number of N in order of 1, 2, . . . , N−1 and N, and sub-fields, which have the address period applying the scan pulse to the scan electrodes in order of N, N−1 , . . . , 2 and 1.

27 Claims, 5 Drawing Sheets

FOREIGN PATENT DOCUMENTS

| | | | |
|---|---|---|---|
| JP | 05-297822 | | 11/1993 |
| JP | 08-305320 | | 11/1996 |
| JP | 09-097570 | | 4/1997 |
| JP | 11-065486 | | 3/1999 |
| JP | 2001-554283 | * | 8/2001 |
| JP | 02001236037 A | * | 8/2001 |

* cited by examiner

W: OVERALL WRITE PERIOD
SL: SEQUENTIAL LINE SELECT AND ERASE ADDRESSING CYCLE

DRIVING METHOD OF PLASMA DISPLAY PANEL

BACKGROUND OF THE INVENTION

1. Field of the Invention

The present invention relates to a driving method of a PDP(Plasma Display Panel), and more particularly, to a driving method of a PDP capable of preventing abnormal discharge and dielectric breakdown due to excess charged particles collected on the outside of a display screen.

2. Background of the Related Art

FIG. 1 illustrates a schematic view of a conventional surface-discharge type AC PDP(Plasma Display Panel). The surface-discharge AC PDP includes a front glass substrate 1, an address electrode 3 formed on the front glass substrate 1, a rear glass substrate 2 opposed to the front glass substrate 1, electrodes X and Y (7 and 8) arranged parallel to each other on the rear glass substrate 2, a dielectric layer 6 formed to cover the electrodes X and Y, an MgO protection layer formed on the dielectric layer, and a barrier 4 disposed between the front glass substrate 1 and the rear glass substrate 2 and dividing a discharge space.

FIG. 2 illustrates an arrangement of driving electrodes of the PDP of FIG. 1. The driving electrodes include a plurality of address electrodes A1, A2, A3, . . . , Am−1 and Am arranged parallel to one another and a plurality of electrodes X and electrodes Y Y1, Y2, Y3, . . . , Yn−1 and Yn arranged approximately vertical to the address electrodes. Discharge cells are formed at intersections of the electrodes X and Y and the address electrodes, electrodes Y are scan electrodes and electrodes X are common electrodes connected commonly.

FIG. 3 illustrates an ADS(Address Display-period Separation) method for driving the PDP of FIGS. 1 and 2. In the ADS method, 1 field of video signal is divided into 8 sub-fields; each sub-field consisting of a reset period, an address period and a sustain period. The reset period is a period for initializing the discharge cells by discharging all discharge cells of FIG. 2, the address period is a period for designating the discharge cells to be displayed according to video signal input, and the sustain period is a period for sustain discharge to the discharge cells designated in the address period. In the sustain period of each sub-field, a weight value is assigned as a display period, thereby combining the sub-fields to display multi-grade.

In general, scan lines Y1, Y2, Y3, . . . , Yn−1 and Yn of the PDP of FIG. 2, in case of a VGA(Video Graphics Array), consist of 480 lines, and the address operation is carried out by scanning to each line in a line sequential method, and at the same time, applying data signal through the address electrodes. As shown in FIG. 3, in the ADS method of dividing 1 video field into 8 sub-fields and having the address periods for all scan lines every sub-field, the scan period of 1 scan line is about 2.5 μs, and a period for scanning the whole 1 video field is approximately 2.5 (μs)×480 (lines)×8 (sub-fields), namely 9.6 μs. Because it takes 9.6 μs to scan if the 1 video field is about 16.7 μs, the residual period, that is, 7.1 μs is used for gray scale. However, if the number of the sub-fields is increased to 10 to remove false contour or to increase the number of gray scales, the scan period is 2.5 (μs)×480 (lines)×10 (sub-fields), namely 12 μs, and so, display must be performed in very high frequency because there is the period for the gray scale of only 4.7 μs left. Furthermore, In case that scan lines over 760 are used in an HD TV(High Definition TV), the scan period is 2.5 (μs)×760 (lines)×8 (sub-fields), namely 15.2 μs; most of 1 video period being used for the scan period.

To solve the above problems, as shown in FIG. 4, there is used a driving method of dividing the address electrodes into upper and lower parts. The method has a disadvantage that a plurality of driving ICs are used, but has several advantages that sub-fields more than that of the prior arts can be applied and the method can be used in the HD TV of scan lines over 760 by reducing the scan period to ½.

FIG. 5 illustrates a scan sequence in a driving method of a conventional PDP. In the scan sequence, a scan pulse is applied to the scan electrodes (electrodes Y) of 1, 2, . . . and 480 lines every sub-field in order, and at the same time, an input video data pulse is applied to the address electrodes. At this time, if the scanning is performed repeatedly, electric potential rises or falls by accumulation or vanishment of excess charged particles on the outer portion of a display screen adjacent to the scan electrode of the final line, i.e., the $480^{th}$ line. So, there occurs abnormal discharge on the cells in vicinity of the scan electrode of the $480^{th}$ line, thereby reducing reliability by deteriorating video quality or by occurring dielectric breakdown.

In the same way, FIG. 6 illustrates a scan sequence in a driving method of a conventional PDP in which address electrodes are divided into two. For example, when an addressing is performed in order of $1^{st}$~$240^{th}$ lines and in order of $241^{st}$~$480^{th}$, electric charges are abnormally collected on a boundary between upper address electrodes and lower address electrodes, i.e., a central part, and on the outer portion of a display screen of $480^{th}$ line and electric potential rises, thereby, occurring abnormal discharge on the cells in vicinity of the central part and of the $480^{th}$ line to deteriorate the video quality or generate dielectric breakdown.

SUMMARY OF THE INVENTION

Accordingly, the present invention is directed to a driving method of a PDP(Plasma Display Panel) that substantially obviates one or more problems due to limitations and disadvantages of the related art.

An object of the present invention is to provide a driving method of a PDP, which can prevent abnormal discharge and dielectric breakdown due to excess charged particles collected on the outside of a display screen.

Another object of the present invention is to provide a driving method of a PDP, which can prevent abnormal discharge and dielectric breakdown occurring at a divided central part of the PDP adopting a method of driving by dividing address electrodes.

Additional advantages, objects, and features of the invention will be set forth in part in the description which follows and in part will become apparent to those having ordinary skill in the art upon examination of the following or may be learned from practice of the invention. The objectives and other advantages of the invention may be realized and attained by the structure particularly pointed out in the written description and claims hereof as well as the appended drawings.

To achieve these objects and other advantages and in accordance with the purpose of the invention, as embodied and broadly described herein, a driving method of a PDP (Plasma Display Panel) including a pair of substrates arranged at a prescribed interval, a plurality of address electrodes formed on one of the substrates and scan electrodes to the number of N formed to intersect the address electrodes comprises the steps of: dividing 1 field of input video signal into a plurality of sub-fields having brightness weight respectively; and applying a scan pulse to the scan electrodes to the number of N in order and simultaneously applying an input video data signal pulse to the plurality of address electrodes, in each sub-field, to have an address period designating cells to be displayed and a sustain period applying a sustain pulse to the designated cells according to the brightness weight of the corresponding sub-field, wherein the plurality of sub-fields include sub-fields, which have the address period applying the scan pulse to the scan electrodes to the number of N in order of 1, 2, . . . , N−1 and N, and sub-fields, which have the address period applying the scan pulse to the scan electrodes in order of N, N−1 , . . . , 2 and 1.

It is preferable that the sub-fields, which have the address period applying the scan pulse to the scan electrodes to the number of N in order of 1, 2, . . . , N−1 and N, are odd number sub-fields and the sub-fields, which have the address period applying the scan pulse to the scan electrodes in order of N, N−1, . . . , 2 and 1, are even number sub-fields.

In another aspect of the present invention, a driving method of a PDP(Plasma Display Panel) including a pair of substrates arranged at a prescribed interval, a plurality of address electrodes formed on one of the substrates, the address electrodes being divided into an upper part and a lower part, and scan electrodes to the number of N formed to intersect the address electrodes comprises the steps of: dividing 1 field of input video signal into a plurality of sub-fields having brightness weight respectively; and applying a scan pulse to the scan electrodes to the number of N/2 intersecting the upper or lower address electrodes in order and simultaneously applying an input video data signal pulse to the upper or lower address electrodes, in each sub-field, to have an address period designating cells to be displayed and a sustain period applying a sustain pulse to the designated cells according to the brightness weight of the corresponding sub-field, wherein the plurality of sub-fields include sub-fields, which have the address period applying the scan pulse to the scan electrodes to the number of N/2 in order of 1, 2, . . . and N2 and in order of (N/2)+1, . . . and N, and sub-fields, which have the address period applying the scan pulse to the scan electrodes to the number of N/2 in order of N/2, . . . , 2 and 1 and in order of N, N−1 and (N/2)+1.

It is preferable that the sub-fields, which have the address period applying the scan pulse to the scan electrodes to the number of N/2 respectively intersecting the upper and lower address electrodes in order of 1, 2, . . . and N/2 and in order of (N/2)+1, . . . and N, are odd number sub-fields, and the sub-fields, which have the address period applying the scan pulse to the scan electrodes to the number of N/2 intersecting the upper address electrodes in order of N/2, . . . , 2 and 1 and in order of N, N−1, and (N/2)+1, are even number sub-fields.

Additionally, it is preferable that in each sub-fields, the scan pulse to the scan electrodes intersecting the upper address electrodes is applied in order of 1, 2, . . . and N/2 and the scan pulse to the scan electrodes intersecting the lower address electrodes is applied in order of N, N−1, . . . and (N/2)+1.

It is to be understood that both the foregoing general description and the following detailed description of the present invention are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this application, illustrate embodiment(s) of the invention and together with the description serve to explain the principle of the invention. In the drawings.

DETAILED DESCRIPTION OF THE PREFERRED EMBODIMENT

Reference will now be made in detail to the preferred embodiments of the present invention, examples of which are illustrated in the accompanying drawings.

Figure 7:
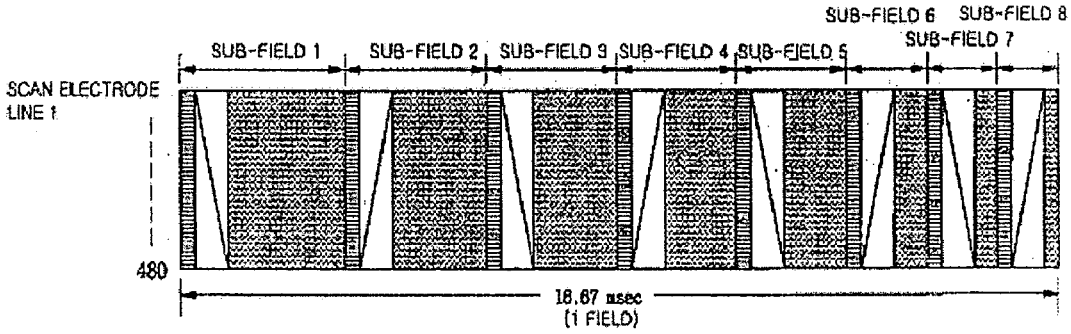
FIG. 7 illustrates a view of a scan sequence in a driving method for a PDP according to the present invention.

FIG. 7 illustrates an ADS(Address Display-period Separation) driving method of a PDP(Plasma Display Panel) according to the present invention. In the ADS driving method, 1 field of video signal of about 16.67 μs is divided into, for example, 8 sub-fields; each sub-field consisting of a reset period, an address period and a sustain period.

The reset period is a period for uniforming discharge conditions of all cells by applying voltage of about 350 V higher than sustain voltage.

Figure 1:
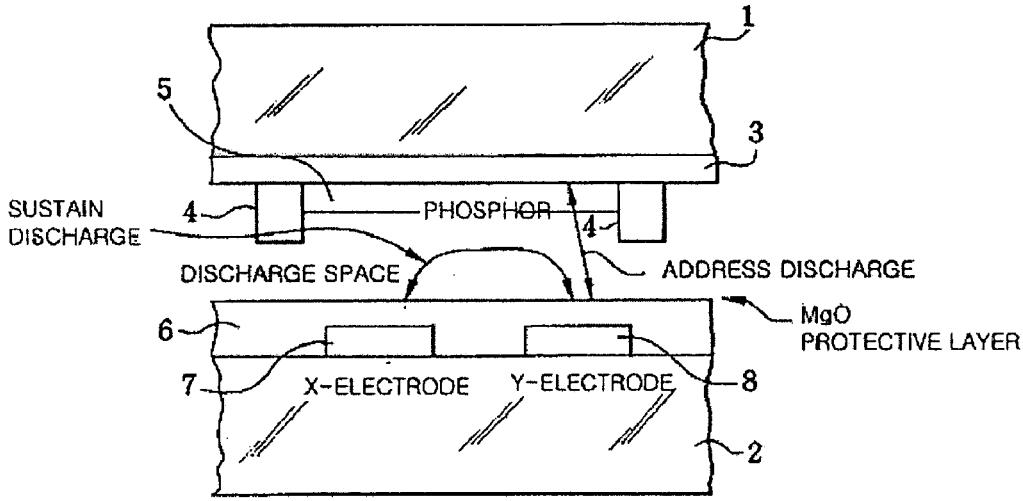
FIG. 1 illustrates a schematic view of a structure of a conventional surface-discharge AC PDP(Plasma Display Panel)
Figure 2:
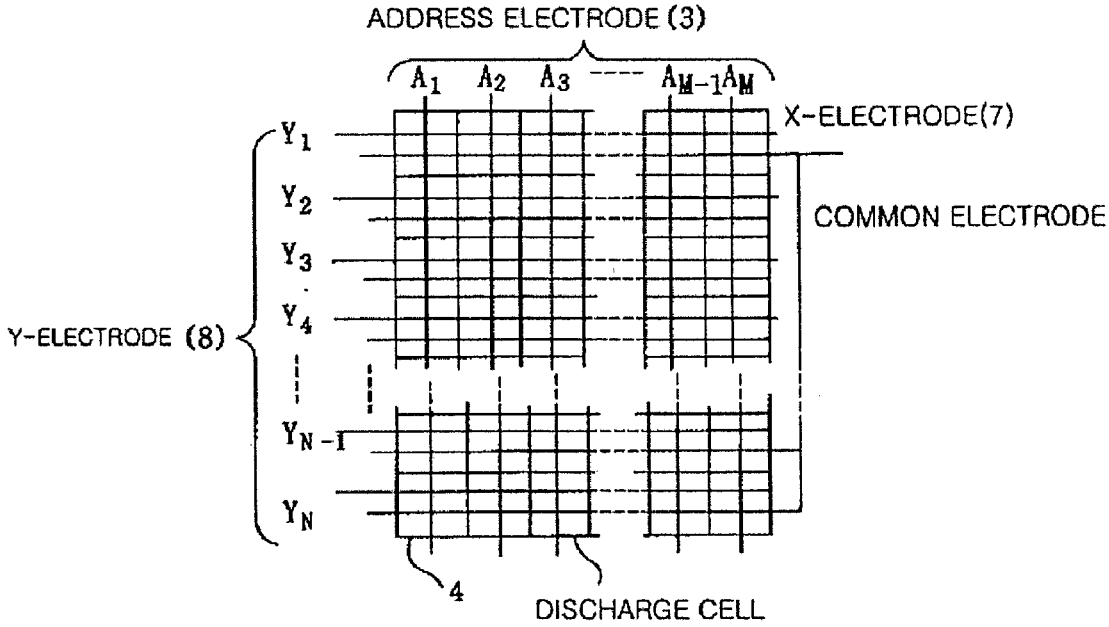
FIG. 2 illustrates a view showing an arrangement of electrodes for driving the PDP.
Figure 3:
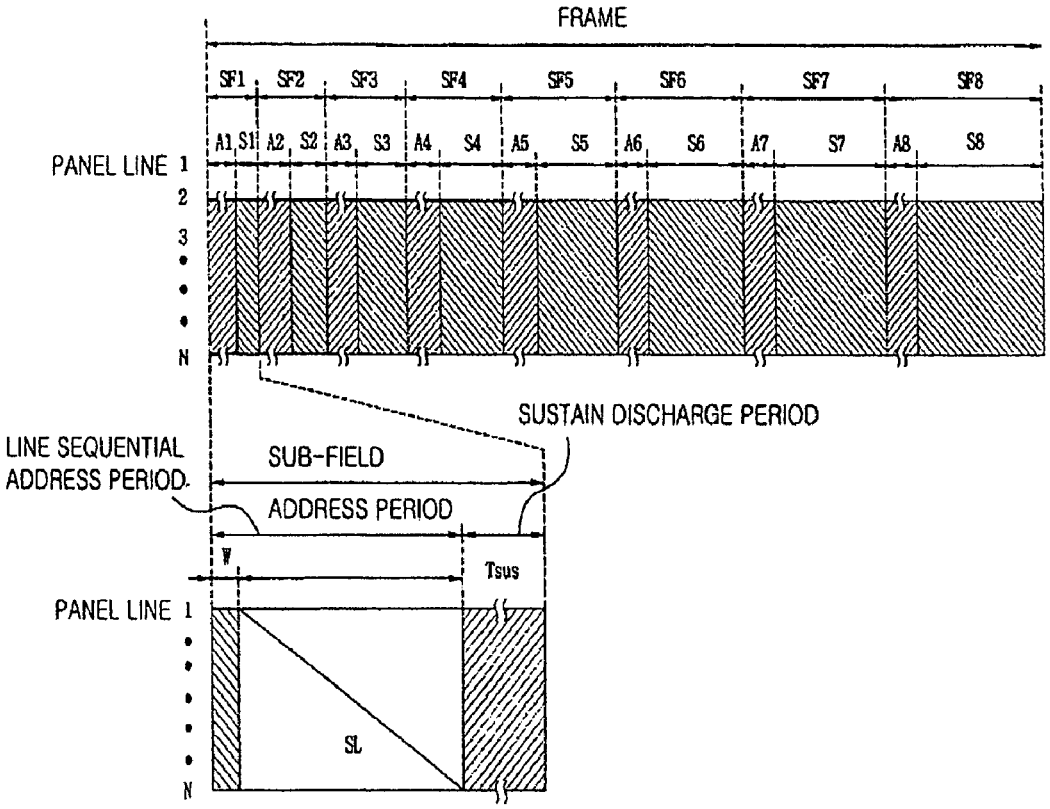
FIG. 3 illustrates a view of a sub-field structure in an ADS(Address Display-period Separation) method.
Figure 4:
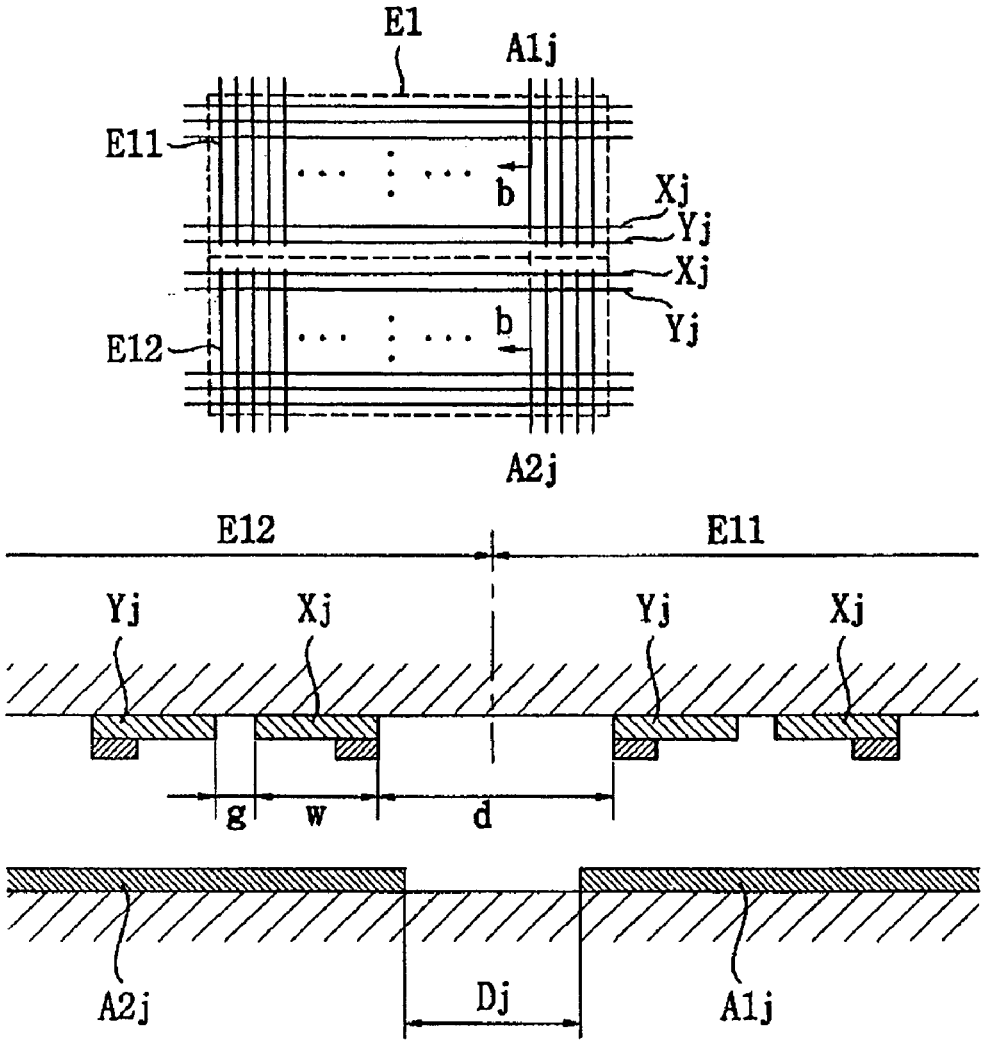
FIG. 4 illustrates a view of a PDP having a bipartite address electrode structure.
Figure 5:
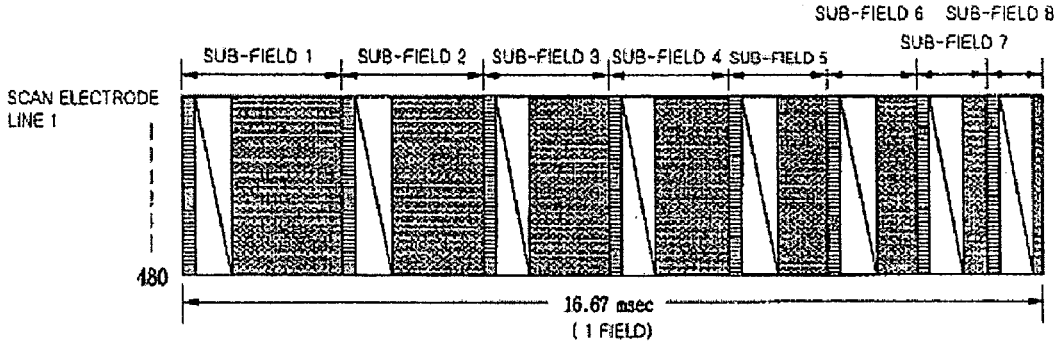
FIG. 5 illustrates a view of a scan sequence in a conventional PDP driving method.
Figure 6:
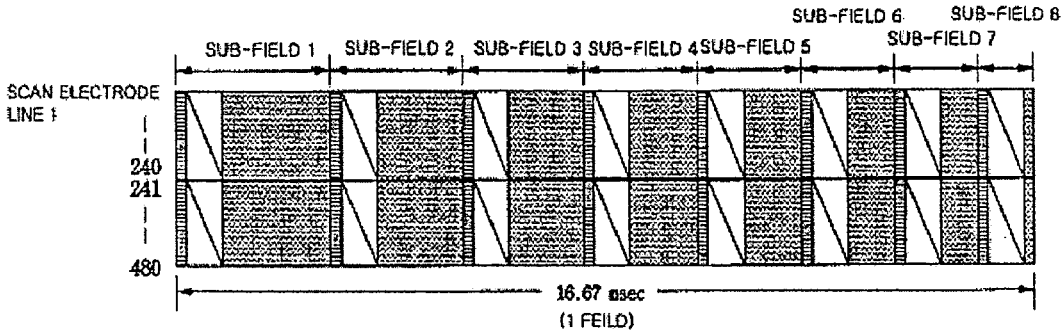
FIG. 6 illustrates a view of a scan sequence in a conventional driving method of the PDP in which address electrodes are divided into two.

The address period is a period for designating discharge cells, to be displayed, by applying a scan pulse to a plurality of scan electrodes (electrodes Y in FIG. 2) in order and, at the same time, by applying input video data signal to address electrodes. The designation of the cells, to be displayed, is made in such a manner that address discharge occurs by applying the scan pulse to the scan electrodes and applying data pulse of the address electrodes, and thereby space charged particle is generated and wall charges are collected on a dielectric layer (MgO layer) covering the scan electrodes shown in FIG. 1. After that, if a sustain pulse is applied to the scan electrodes and common electrodes in turn during the sustain period, the sustain voltage is added to the collected wall charges, thereby generating sustain discharge. On the other side, the cells, on which the wall charges are not collected, (nondesignated cells without data input) do not generate the sustain discharge because having only the sustain pulse. This function calls a memory function or a designation function of the cells, to be displayed.

FIG. 7 illustrates a driving method of the PDP according to a preferred embodiment of the present invention. First, third, fifth and seventh sub-fields apply the scan pulse to the scan electrodes in order of 1, 2, . . . and $480^{th}$ lines and second, fourth, sixth and eighth sub-fields apply the scan pulse to the scan electrodes in order of $480^{th}$, $479^{th}$, . . . , $2^{nd}$ and $1^{st}$ lines. In such a manner, the polarity of excess charged particle generated on the scan electrode of the $480^{th}$ line in the odd number sub-fields and that of charged particle generated in the scan electrode of $480^{th}$ line in the even number sub-fields are opposed to each other, thereby reducing or removing the excess charged particles collected finally. After all, the reduction or removal of the excess charged particles can prevent abnormal discharge or dielectric breakdown on the discharge cells in vicinity of the scan electrode of the $480^{th}$ line.

Figure 8:
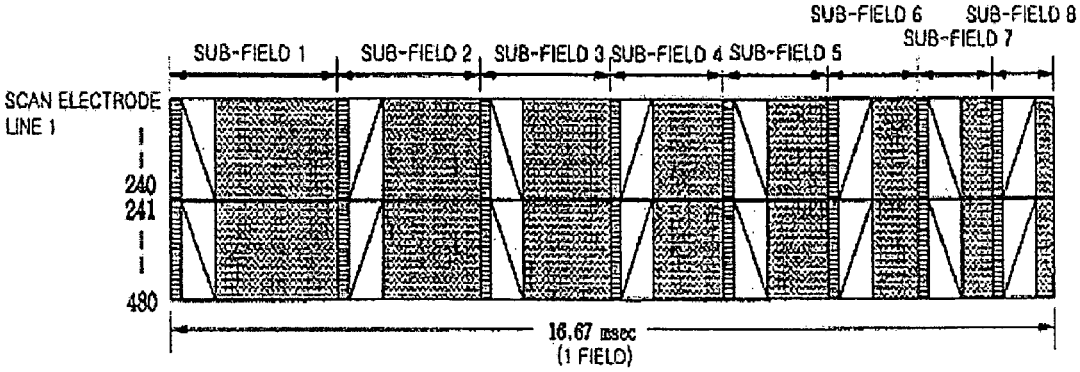
FIG. 8 illustrates a view of a scan sequence in a driving method of a PDP, in which address electrodes are divided into two, according to the present invention.

FIG. 8 illustrates a driving method of a PDP, in which the address electrodes are divided into two, according to the present invention. The first, third, fifth and seventh sub-fields apply the scan pulse to the scan electrodes in order of $1^{st}$ to $240^{th}$ lines intersecting upper address electrodes and in order of $241^{st}$ to $480^{th}$ lines intersecting lower address electrodes, and the second, fourth, sixth and eighth sub-fields apply the scan pulse to the scan electrodes in order of $240^{th}$ to $1^{st}$ lines intersecting the upper address electrodes and in order of $480^{th}$ to $241^{st}$ lines intersecting the lower address electrodes. In such a manner, the polarity of the excess charged particles generated on the central part in the odd number sub-fields and that of the charged particles generated through the address discharge of the central part in the even number sub-fields are opposed to each other, thereby reducing or removing the excess charged particles collected finally. After all, the reduction or removal of the excess charged particles can prevent abnormal discharge or dielectric breakdown on the discharge cells in vicinity of the central part, i.e., the discharge cells in vicinity of the scan electrode of the $240^{th}$ line and the scan electrode of the $241^{st}$ line.

Figure 9:
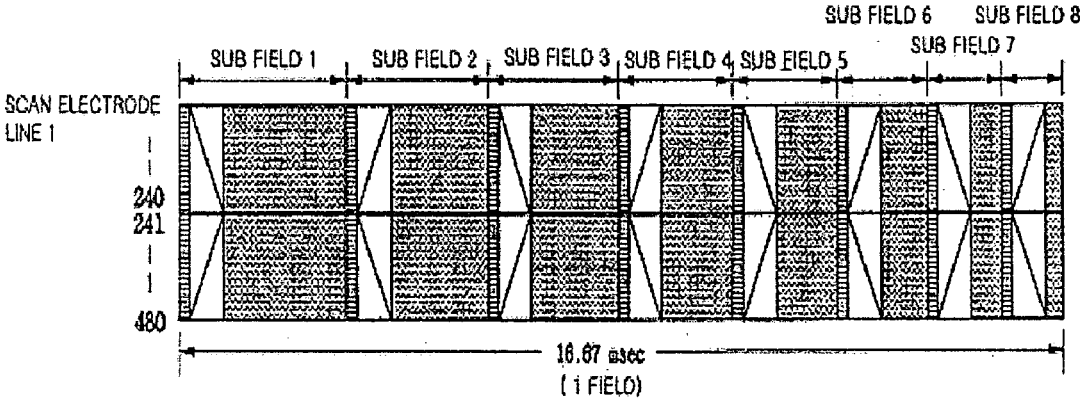
FIG. 9 illustrates a view of another scan sequence in the driving method of the PDP , in which address electrodes are divided into two, according to the present invention.

FIG. 9 illustrates a driving method of a PDP, in which the address electrodes are divided into two, according to another preferred embodiment of the present invention. The odd number sub-fields apply the scan pulse to the scan electrodes in order of $1^{st}$, $2^{nd}$, . . . and $240^{th}$ lines intersecting the upper address electrodes and in order of $480^{th}$, $479^{th}$, . . . and $241^{st}$ lines intersecting the lower address electrodes, and the even number sub-fields apply the scan pulse to the scan electrodes in order of $240^{th}$, $239^{th}$, . . . and $1^{st\ 1}$ lines intersecting the upper address electrodes and in order of $241^{th}$, $242^{nd}$, and $480^{th}$ lines intersecting the lower address electrodes. It has the same effect as the first embodiment.

Additionally, not shown in the drawings, but it is also possible that the even number sub-fields apply the scan pulse to the scan electrodes in order $1^{st}$, $2^{nd}$, . . . and $240^{th}$ lines intersecting the upper address electrodes and in order of $241^{st}$, $242^{nd}$, . . . and $480^{th}$ lines intersecting the lower address electrodes, and the odd number sub-fields apply the scan pulse to the scan electrodes in order of $240^{th}$, $239^{th}$, . . . and $1^{st}$ lines intersecting the upper address electrode and in order of $480^{th}$, 479, . . . and $241^{st}$ lines intersecting the lower address electrodes.

According to the present invention, it is possible to prevent the abnormal discharge or dielectric breakdown generated by the charged particles collected on or vanished from the outside of the display screen.

Moreover, it is possible to prevent the abnormal discharge or dielectric breakdown generated at the divided central part of the PDP adopting the ADS method.

The forgoing embodiments are merely exemplary and are not to be construed as limiting the present invention. The present teachings can be readily applied to other types of apparatuses. The description of the present invention is intended to be illustrative, and not to limit the scope of the claims. Many alternatives, modifications, and variations will be apparent to those skilled in the art.

What is claimed is:

1. A method of driving a PDP (Plasma Display Panel) including a pair of substrates, a plurality of address electrodes formed on one of the substrates and scan electrodes to the number of N formed to intersect the address electrodes, wherein the method of driving comprises:

dividing a field of an input video signal into a plurality of sub-fields having brightness weights; and applying a scan pulse to the scan electrodes to the number of N in order and simultaneously applying an input video data signal pulse to the plurality of address electrodes, in each sub-field, to have an address period designating cells to be displayed and a sustain period applying a sustain pulse to the designated cells according to the brightness weight of the corresponding sub-field, wherein the plurality of sub-fields include sub-fields, which have the address period applying the scan pulse to the scan electrodes to the number of N in order of 1, 2, . . . , N−1 and N, and sub-fields, which have the address period applying the scan pulse to the scan electrodes in order of N, N−1, . . . , 2 and 1.

2. The method according to claim 1, wherein the sub-fields, which have the address period applying the scan pulse to the scan electrodes to the number of N in order of 1, 2, . . . , N−1 and N, are odd numbered sub-fields and the sub-fields, which have the address period applying the scan pulse to the scan electrodes in order of N, N−1, . . . , 2 and 1, are even numbered sub-fields.

3. The method according to claim 1, wherein the sub-fields, which 1 have the address period applying the scan pulse to the scan electrodes to the number of N in order of 1, 2, and N−1 and N, are even numbered sub-fields and the sub-fields, which have the address period applying the scan pulse to the scan electrodes in order of N, N−1, . . . 2 and 1, are odd numbered sub-fields.

4. A method of driving a PDP (Plasma Display Panel) including a pair of substrates, a plurality of address electrodes formed on one of the substrates, the address electrodes being divided into an upper part and a lower part, and scan electrodes to the number of N formed to intersect the address electrodes, wherein the method of driving comprises:

dividing a field of an input video signal into a plurality of sub-fields having brightness weights; and applying a scan pulse to the scan electrodes to the number of N/2 intersecting the upper and lower address electrodes in order and simultaneously applying an input video data signal pulse to the upper and lower address electrodes, in each sub-field, to have an address period designating cells to be displayed and a sustain period applying a sustain pulse to the designated cells according to the brightness weight of the corresponding sub-field, wherein the plurality of sub-fields include sub-fields, which have the address period applying the scan pulse to the scan electrodes to the number of N/2 intersecting the upper address electrodes in order of 1, 2, . . . , and N/2 and applying the scan pulse to the scan electrodes to the number of N/2 intersecting the lower address electrodes in order of (N/2)+1, . . . , and N, and sub-fields, which have the address period applying the scan pulse to the scan electrodes to the number of N/2 intersecting the upper address electrodes in order of N/2, . . . , 2 and 1 and applying the scan pulse to the scan electrodes to the number of N/2 intersecting the lower address electrodes in order of N, N−1, and (N/2)+1.

5. The method according to claim 4, wherein the sub-fields, which have the address period applying the scan pulse to the scan electrodes to the number of N/2 respectively intersecting the upper and lower address electrodes in order of 1, 2 , . . . , and N/2 and in order of (N/2)+1, . . . , and N, are odd numbered sub-fields, and the sub-fields, which have the address period applying the scan pulse to the scan electrodes to the number of N/2 intersecting the upper address electrodes in order of N/2, . . . , 2 and 1 and in order of N, N−1, and (N/2)+1, are even numbered sub-fields.

6. The method according to claim 4, wherein the sub-fields, which have the address period applying the scan pulse to the scan electrodes to the number of N/2 respectively intersecting the upper and lower address electrodes in order of 1, 2, . . . , and N/2 and in order of N/2)+1, . . . and N, are even numbered sub-fields, and the sub-fields, which have the address period applying the scan pulse to the scan electrodes to the number of N/2 intersecting the upper address electrodes in order of N/2, . . . , 2 and 1 and in order of N, N−1, and (N/2)+1, are odd numbered sub-fields.

7. A method of driving a PDP (Plasma Display Panel) including a pair of substrates arranged at a prescribed interval, a plurality of address electrodes formed on one of the substrates, the address electrodes being divided into an upper part and a lower part, and scan electrodes to the number of N formed to intersect the address electrodes, the method of driving comprising:

dividing a field of an input video signal into a plurality of sub-fields having brightness weights; and applying a scan pulse to the scan electrodes to the number of N/2 intersecting the upper and lower address electrodes in order and simultaneously applying an input video data signal pulse to the upper and lower address electrodes, in each sub-field, to have an address period designating cells to be displayed and a sustain period applying a sustain pulse to the designated cells according to the brightness weight of the corresponding sub-field, wherein the plurality of sub-fields include sub-fields, which have the address period applying the scan pulse to the scan electrodes to the number of N/2 intersecting the upper address electrodes in order of N/2, (N/2)−1, . . . and 1 and applying the scan pulse to the scan electrodes to the number of N/2 intersecting the lower address electrodes in order of (N/2)+1, . . . and N, and sub-fields, which have the address period applying the scan pulse to the scan electrodes to the number of N/2 intersecting the upper address electrodes in order of 1, 2, . . . and N/2 and applying the scan pulse to the scan electrodes to the number of N/2 intersecting the lower address electrodes in order of N, N−1, and (N/2)+1.

8. The method according to claim 7, wherein the sub-fields, which have the address period applying the scan pulse to the scan electrodes to the number of N/2 respectively intersecting the upper and lower address electrodes in order of N/2, (N/2)−1, and 1 and in order of N/2)+1, . . . and N, are odd numbered sub-fields, and the sub-fields, which have the address period applying the scan pulse to the scan electrodes to the number of N/2 intersecting the upper address electrodes in order of 1, 2, . . . and N/2 and in order of N, N−1, and (N/2)+1, are even numbered sub-fields.

9. The method according to claim 7, wherein the sub-fields, which have the address period applying the scan pulse to the scan electrodes to the number of N/2 respectively intersecting the upper and lower address electrodes in order of N/2, (N/2)−1, and 1 and in order of N/2)+1, . . . and N, are even numbered sub-fields, and the sub-fields, which have the address period applying the scan pulse to the scan electrodes to the number of N/2 intersecting the upper address electrodes in order of 1, 2, and N/2 and in order of N, N−1, and (N/2)+1, are odd numbered sub-fields.

10. A method of driving a PDP (Plasma Display Panel) having a plurality of scan electrodes divided in two, comprising:

applying a first scan pulse to each of the scan electrodes in ascending number order from 1 to K during an addressing period of a first sub-field;

applying the first scan pulse to each of the scan electrodes in ascending number order from K+1 to N during the addressing period of a first sub-field;

applying a second scan pulse to each of said scan electrodes in descending number order from N to K+1 during an addressing period of a second sub-field; and applying the second scan pulse to each of the scan electrodes in descending number order from K+1 to 1 during the addressing period of the second sub-field K and N are integers.

11. The method according to claim 10, wherein charged particles generated by said first and second scan pulses are opposed to each other and reduce the amount of excess charged particles residually.

12. The method according to claim 11, wherein said reduction of excess charged particles prevents abnormal discharge or dielectric break down.

13. The method according to claim 10, wherein N is 480.

14. The method according to claim 10, wherein said first scan pulse comprises multiple odd-numbered pulses.

15. The method according to claim 10, wherein said second scan pulse comprises multiple even-numbered pulses.

16. The method according to claim 10, wherein said first scan pulses occur in odd numbered sub-fields of a field.

17. The method according to claim 10, wherein said second scan pulses occur in even numbered sub-fields of a field.

18. The method as claimed in claim 10, further comprising:

applying at least one sustain pulse during a sustain period of the first sub-field, the sustain period of the first sub-field being after the address period of the first sub-field and before the address period of the second sub-field.

19. The method as claimed in claim 10, wherein the first sub-field includes a single reset period, a single address period and a single sustain period, and the second sub-field includes a different single reset period, a different single address period, and a different single sustain period.

20. The method as claimed in claim 10, wherein the second sub-field is a different sub-field than the first sub-field.

21. The method as claimed in claim 10, wherein K is N/2 and N corresponds to a number of all scan lines.

22. A method of driving a PDP (Plasma Display Panel) having a plurality of scan electrodes divided in two, comprising:

applying a first scan pulse to each of the scan electrodes in ascending number order from 1 to K during an addressing period of a first sub-field;

applying the first scan pulse to each of the scan electrodes in descending number order from N to K+1 during the addressing period of the first sub-field;

applying a second scan pulse to each of said scan electrodes in descending number order from K to 1 during an addressing period of a second sub-field; and applying the second scan pulse to each of the scan electrodes in ascending number order from K+1 to N during the addressing period of the second sub-field K and N are integers.

23. The method according to claim 10, wherein said applying first scan pulse to said scan electrodes in ascending order from 1 to N occurs in 16.67 msec.

24. The method as claimed in claim 22, further comprising:

applying at least one sustain pulse during a sustain period of the first sub-field, the sustain period of the first sub-field being after the address period of the first sub-field and before the address period of the second sub-field.

25. The method as claimed in claim 22, wherein the first sub-field includes a single reset period, a single address period and a single sustain period, and the second sub-field includes a different single reset period, a different single address period, and a different single sustain period.

26. The method as claimed in claim 22, wherein the second sub-field is a different sub-field than the first sub-field.

27. The method as claimed in claim 22, wherein K is N/2 and N corresponds to a number of all scan lines.

* * * * *